US009932723B2

(12) United States Patent
Triginer Boixeda et al.

(10) Patent No.: US 9,932,723 B2
(45) Date of Patent: Apr. 3, 2018

(54) LOCKING DEVICE FOR A WEAR MEMBER OF AN EARTH MOVING MACHINE

(71) Applicant: METALOGENIA RESEARCH & TECHNOLOGIES S.L., Barcelona (ES)

(72) Inventors: Jorge Triginer Boixeda, Barcelona (ES); Javier Rol, Barcelona (ES)

(73) Assignee: METALOGENIA RESEARCH & TECHNOLOGIES S.L., Barcelona (ES)

( * ) Notice: Subject to any disclaimer, the term of this patent is extended or adjusted under 35 U.S.C. 154(b) by 0 days.

(21) Appl. No.: 15/121,860

(22) PCT Filed: Feb. 26, 2015

(86) PCT No.: PCT/EP2015/054089
§ 371 (c)(1),
(2) Date: Aug. 26, 2016

(87) PCT Pub. No.: WO2015/128439
PCT Pub. Date: Sep. 3, 2015

(65) Prior Publication Data

US 2017/0016212 A1 Jan. 19, 2017

(30) Foreign Application Priority Data

Feb. 27, 2014 (EP) ..... 14382072

(51) Int. Cl.
*E02F 9/28* (2006.01)
*E02F 3/815* (2006.01)

(52) U.S. Cl.
CPC ..... *E02F 9/2833* (2013.01); *E02F 3/8152* (2013.01); *E02F 3/8157* (2013.01); *E02F 9/2841* (2013.01); *E02F 9/2883* (2013.01)

(58) Field of Classification Search
CPC ..... E02F 9/2818; E02F 9/2825; E02F 9/2833; E02F 9/2883; E02F 9/2841; E02F 3/8152; E02F 3/8157; Y10T 403/7067
(Continued)

(56) References Cited

U.S. PATENT DOCUMENTS 5,410,826 A * 5/1995 Immel ..... E02F 9/2833 37/455
5,964,547 A * 10/1999 Brinkley ..... E02F 9/2825 37/456

(Continued)

FOREIGN PATENT DOCUMENTS

WO 01/25551 A1 4/2001
WO 2008/119103 A1 10/2008

OTHER PUBLICATIONS

International Search Report for PCT/EP2015/054089 dated May 4, 2015.
Written Opinion for PCT/EP2015/054089 dated May 4, 2015.

*Primary Examiner* — Robert E Pezzuto
(74) *Attorney, Agent, or Firm* — Sughrue Mion, PLLC

(57) ABSTRACT

Locking devices and components for wear assemblies for securing a wear part to the blade or lip of an excavator. The wear part will usually be a tooth adaptor, and when placed on the blade both parts determine a channel where the locking device is placed. The locking device will usually include a C-clamp member for mounting in the rearward of the channel, a front structure to engage to the frontward of the channel and a wedge structure placed between the C-clamp member and the front structure.

14 Claims, 7 Drawing Sheets

(58) Field of Classification Search
USPC ..... 37/446, 452–460; 172/701.1–701.3; 403/350, 374.3, 379.4
See application file for complete search history.

(56) References Cited

U.S. PATENT DOCUMENTS

| | | | | |
|---|---|---|---|---|
| 6,009,644 | A * | 1/2000 | Hedley | E02F 9/2833 37/456 |
| 6,986,216 | B2 * | 1/2006 | Emrich | E02F 9/2833 37/450 |
| 7,516,564 | B2 * | 4/2009 | Ruvang | E02F 9/2833 37/456 |
| 8,458,931 | B2 * | 6/2013 | Knight | E02F 9/2833 37/456 |
| 2004/0107608 | A1 | 6/2004 | Meyers et al. | |
| 2011/0072693 | A1 | 3/2011 | Knight | |
| 2011/0258891 | A1 | 10/2011 | Ruvang | |
| 2013/0247429 | A1 | 9/2013 | Campomanes | |

* cited by examiner

LOCKING DEVICE FOR A WEAR MEMBER OF AN EARTH MOVING MACHINE

CROSS REFERENCE TO RELATED APPLICATIONS

This application is a National Stage of International Application No. PCT/EP2015/054089 filed Feb. 26, 2015, claiming priority based on European Patent Application No. 14382072.8 filed Feb. 27, 2014, the contents of all of which are incorporated herein by reference in their entirety.

OBJECT OF THE INVENTION

The present invention refers to locking devices and its components for wear assemblies for securing a wear part to the blade or lip of an excavator. Said wear part will usually be a teeth adaptor, and when placed on the blade both parts determine a channel where the locking device is placed. Said locking device will usually comprise a C-clamp member for mounting in the rearward of said channel, a front structure to engage to the frontward of the channel and a wedge structure placed between the C-clamp member and the front structure.

Further, a locking device that only comprises a wedge and a C-clamp member are also object of the present invention.

The present invention especially applies to the excavation and earthmoving industries, such as mining and quarrying.

BACKGROUND OF THE INVENTION

Excavators and similar machines, such as those used in mining and quarrying are used for earthmoving material as moving and loading earth and stones. These machines are usually provided with a bucket or dipper attached to a mechanical arm. The bucket is provided with a blade or lip on a front edge for penetrating the ground and loading stones. To prevent excessive wearing of the blade and to aid penetrating the ground, it is common to assemble wear parts that protect the blade of the bucket. The wear parts may be teeth, adapters, shrouds or others. The wear parts can be fixed to the blade in different ways, such as welded, be part of the blade or be mechanically attached. The mechanical attachments have the advantage that they allow disassembling and assembling of the parts. Because said wear parts are subjected to wear and impacts too, they must be frequently replaced. Further, mechanical attachments do not need to use welding. On the other hand, the adapters are often welded to the blade of the bucket but they can also be mechanically attached, as in the present invention. The most common known adapters in the state of the art, specifically in mining, are the Whisler type adapters. In mining, the tooth and adapter assemblies work in hard abrasive and high impact conditions that require the replacement of the wear parts (teeth and adapters) frequently. Further, the blades of the excavators sometimes contain a high percentage of manganese that increases the hardness of the blade against impacts, but these blades do not allow welding. This type of adapter comprises a pair of arms that fit over the top and bottom surfaces of the blade of the excavator, including each arm of the adapter and blade holes that are aligned forming a channel. In said channel a C-clamp member and a wedge are introduced to lock the adapter on the blade. The wedge is inserted between the C-clamp member and the front of the channel pushing the C-clamp member rearwards and making that the legs of the C-clamp member exert pressure on the legs of the adapter, that press against the blade, securing the adapter to the blade. The insertion of the wedge is made by blows with a hammer.

This way of securing the adapter and the blade is time-consuming. Furthermore, an important aspect is that in mining works the security is very important, and during the mounting and removing process of the locking device to mount or replace the adapter, the wedge can fly out of its position with the resulting risk for the workers around. Further, under heavy loading the locking device gets lost and as such the adapter. In some occasions to prevent the mentioned problems, and once the wedge is introduced, the same is welded to the C-clamp member or welded to a front element place between the front of the channel and the wedge, as in prior art document U.S. Pat. No. 4,357,765. Welding different parts of the locking system makes, among other problems, the removal of the locking device and the removal of the adapter more difficult.

In the state of the art several documents try to solve the problem of inserting and removing the locking device from the assembly using hammerless systems. Two examples of hammerless systems are described in WO2008140878A1 and U.S. Pat. No. 7,299,570B2. Both solutions include a thread between the wedge and the front structure, in WO2008140878, or between the wedge and the C-clamp member, in U.S. Pat. No. 7,299,570. In this second patent document, the wedge is conically shaped with a thread that engages a thread on the C-clamp member, so that when the wedge is rotated, the same goes in and out of the channel, assuring the position of the locking system and of the adapter over the blade. Patent application WO2008140878A1 describes a locking system that comprises a wedge with a thread that engages a front structure with a screw. A stem on the top part of the front structure makes the screw rotate and therefore the wedge can go in and out of the channel.

Both embodiments require for removing the locking system to unscrew the wedge along its whole length making said operation time consuming and difficult as the thread will probably be filled with sand that makes its turning difficult.

The present invention allows an easy insertion of the locking system in the channel between an adapter and the blade of a bucket, but also solves the problems of the prior art regarding the removal of the locking system without the need to unscrew the wedge all along its length and neither use a hammer.

DESCRIPTION OF THE INVENTION

For the purpose of overcoming the mentioned drawbacks as well as simplifying the assembly and disassembly of wear parts in the blade of a bucket, the first object of the present invention is a front structure of a locking device for attaching a wear part, specifically an adapter, to the blade of an earth moving machine or excavator.

A second object of the invention is a locking device, for attaching a wear part, specifically an adapter, to the blade of an earth moving machine or excavator, comprising the previous front structure.

Another object of the invention is a locking device comprising a wedge and a C-clamp member with a bolt and a nut between them for attaching a wear part to the blade of an excavator.

A further object of the invention is a C-clamp member.

A wear assembly for attaching a wear part to the blade of an excavator, comprises a wear part, usually an adapter with two arms for fitting over respective top and bottom surfaces of the blade of said excavator, each of said arms and blade having a through-hole, being the same aligned forming a channel, and a locking device introduced within said channel.

Several locking devices can be used to attach the wear part to the blade of the excavator. Usually, the locking device of this invention will comprise:

- a C-clamp member for mounting in the rearward of said channel, having said C-clamp member legs adapted to tightly engage the outer surfaces of the respective arms of said adaptor so as to clamp said arms against the excavator blade;
- a front structure placed in the frontward of said channel, having a lower projection adapted to be placed below the blade, and
- a wedge structure, with a front face and a rear face, placed between said C-clamp member and said front structure for securing said wear part to the blade.

Said front structure comprises a removable upper projection that is placed over the blade to tightly engage to the outer surfaces of the blade, allowing the removal of said upper projection when the wear element or adapter has to be detached from the blade, and comprising a slot and a bolt within the contact surfaces between the C-clamp member and the wedge.

Anyway, other locking devices according to the present invention are possible, for example, a locking device comprising a front structure as the one described with neither the cited C-clamp member nor the wedge structure, or a locking device with the cited C-clamp member and wedge but without the front structure. Further, the use of the locking devices object of the invention is not limited to Whisler type adapters coupled to the blade of an excavator.

Regarding the front structure, the same comprises, in addition to the lower projection, an upper projection that is removably attached to the front structure. The upper projection is attached to the front structure through removable means, preferably a threaded device operated from the upper part of the front structure that is introduced in a vertical cylindrical housing. Said threaded device is a bolt that is screwed to a nut housed in the body of the front structure, crossing the vertical cylindrical housing, and where said nut cannot move, being the upper projection attached between the head of the bolt and the upper surface of the front structure. An alternative construction comprises a front structure with a threaded vertical cylindrical housing, being the bolt screwed inside said housing.

Said upper projection is preferably a washer but other elements with the same purpose can be used. The front structure has a front face to be in contact with the frontward portion of the channel of the blade and a back face to be in contact with a wedge structure. Said back face of the front structure is complementary to the front face of the wedge structure, and both are preferably oppositely inclined and if this is the case, determining a front structure with the shape of a wedge. In this case the lower base of the front structure is bigger that its upperpart. Another possible embodiment of a front structure has a back face that is not inclined to be in contact with a neither inclined front face of a wedge. In this case the wedge has its inclined face on the rear face and it preferably contacts the inclined front face of the C-clamp member.

Further, a locking device comprising a front structure as one of its components, with the features described, is also an object of the present invention, independently of the rest of the components of the locking device, mainly independently of the wedge and the C-clamp member.

The main purposes of this front structure are two, a first one is make easier the removal of the locking device from the coupling between the adapter and the blade, and a second one is protect the blade in the frontward of the channel from the direct efforts exerted by the wedge. The wedge receives external blows while the earth machine or excavator is working, and these external blows or efforts are the ones that through the wedge can damage the frontward surface of the channel.

Another locking device object of the present invention does not comprise the front structure, although said front structure could be incorporated in the locking device if required.

This locking device for attaching a wear part to a blade, having each of them a through hole, that are aligned when coupled the wear part on the blade and forming a channel, comprises a

- a C-clamp member for mounting in the rearward of said channel, having said C-clamp member legs adapted to tightly engage the outer surfaces of the respective arms of said adaptor so as to clamp said arms against the excavator blade; a
- a wedge structure, with a front face and a rear face, placed between said C-clamp member and the frontward surface of the channel for securing said wear part to the blade, comprising a slot and a bolt that is screwed to a nut that can move axially along the slot without rotating within the contact surfaces between the C-clamp member and the wedge. The wedge comprises somewhere in the length of the slot, preferably in the mid-lower half of the slot, and more preferably at the lower end of the slot, stopping projection or stopping means that are pushed down by the nut in its downward movement when the bolt is rotated, pushing therefore the wedge structure too. In this way the nut pushes down the wedge to place it in its working position besides the C-clamp member.

Specifically, the wedge structure has a front face and a back face, this one provided with a slot. The front face is, as mentioned, inclined in respect to the back face, defining the wedge shape of the structure. The slot of the back face extends all along its length, and preferably has a rectangular shape to house a square or rectangular nut placed between said wedge structure and the C-clamp member structure. When this wedge structure is used in a locking device with a front structure as the previously described the front face is provided too with a slot or hollow space to allow the introduction of a tool that operates the removable means of the upper projection. If the locking device does not include said front structure, the wedge can have or not the slot in it front face.

The C-clamp member structure has two legs on its back face, an upper one and a lower one, to engage the outer surfaces of the lower and upper arm of the adaptor that at the same time are placed over the upper and lower surfaces of the blade. Said arms have inclined surfaces. The two inclined surfaces of the legs of the C-clamp member have a complementary inclination with the inclined surfaces of the arms of the adapter. The front face of the C-clamp member, in contact with the wedge structure, has a slot with a rectangular shape nearly all along its length. On the upper end of the front face, there is a housing with circular shape that interrupts the slot with a small protuberance. Above from the housing there is another upper slot section, with a smaller diameter than that of the housing and preferably with circular shape too.

Inside said slot, a threaded bolt is inserted. Said bolt has a square or rectangular nut threaded to it and in its upper end it has a circular washer that is part of the bolt. Means for a tool are placed over the circular washer and are part of the bolt too. The square or rectangular nut is placed within the rectangular shape slot, the circular washer is blocked inside the housing and the means for a tool are placed inside the upper slot section. When the bolt is turned, and as the rectangular nut cannot rotate inside the slot, the nut will move downwards or upwards, depending of the direction the bolt is turned. The bolt can only rotate never displace axially.

As stated, this locking device comprising a C-clamp member and a wedge structure can work alone within the aligned channel of the wear part and the blade, or together with a front structure.

To lock the adapter on the blade of the bucket, the locking device is inserted in the channel between both once the adapter has been placed on the blade and the holes of the arms of the adapter and the hole of the blade have been aligned determining a channel.

A locking device comprising the three components described, front structure with upper projection, a wedge and a C-clamp member, is inserted following the next sequence:

The front structure is placed at the frontward portion of the channel of the blade with its upper projection, the washer, in contact with the upper surface of the blade and the front face in contact with the frontward surface of the channel. Afterwards, the bolt of the front structure is turned with a tool, preferably with an air impact wrench, until its lower projection gets in contact with the lower surface of the blade, and therefore both projections clamp the frontward portion of the channel of the blade, assuring the position of the front structure.

The C-clamp member is inserted and placed in the rearward portion of the channel, engaging with its upper and lower legs the outer surfaces of the arms of the adapter. The back face of the C-clamp member between both legs is in contact with the surface of the back portion of the channel of the blade. The C-clamp member has the bolt and nut inserted in the slot of its front face.

Afterwards, the wedge structure is inserted between the back face of the front structure and the front face of the C-clamp member, being the front inclined face of the wedge structure in contact with the back face of the front structure. Said wedge structure is inserted manually until the wedge structure cannot be moved downwards. The square or rectangular nut threaded to the bolt of the C-clamp member is inserted in the slot placed in the back face of the wedge member.

To secure the wedge structure between the front structure and the C-clamp member, the bolt in the C-clamp member has to be turned with the help of a tool, preferably with an air impact wrench. When turning said bolt the rectangular or square shaped nut goes downwards of the housing formed by the slot of the wedge structure and the slot of the C-clamp member. When said nut reaches the stopping means or stopping projection of the wedge structure, said wedge structure still continues moving downwards a little bit more as the nut pushes down said stopping projection. The wedge pushes the C-clamp backwards and the legs of the C-clamp push tightly on the inclined surfaces of the adapter. The wedge is pushed downwards until the locking device is totally tight in the channel, and therefore the adapter firmly fixed on the blade.

Once the position of the wedge structure has been secured between the front structure and the C-clamp member, the assembly between the adapter and the blade is also secured.

When the adapter needs to be replaced, the locking system must be removed. For this operation, instead of turning the bolt of the C-clamp member in an opposite direction and therefore unscrewing the nut along all the thread of the bolt, the bolt on the front structure should be removed. By unscrewing said bolt from the front structure, the upper projection will be separated from the rest of the front structure. An advantage of this front structure is that its thread is placed away from the dust and sand that could damage the operation of the thread, therefore allowing an easy uncoupling of the front structure. Therefore, said structure that is no longer clamping the blade and cannot maintain its position because there is no upper projection that contacts the upper surface of the blade, will fall down. Once the front structure is not in the channel, the wedge structure may be extracted outward or downward from the channel as there is no surface where it can support, and therefore the locking device can come out from the blocking position and the wear part can then be removed from the blade.

In view of the above, a locking device with a front structure and a conventional wedge and C-clamp member could be installed within a coupling of a wear part and a blade of an excavator as previously described with the difference that the wedge would be introduced between the front structure and the C-clamp with the help of a hammer. Further, a locking device with no front structure or a front structure without a removable upper projection, and with a C-clamp member and a wedge associated by a threaded bolt and a nut as the previously described, would be introduced in the channel of the assembly turning the bolt as previously described and would be disassembled by rotating the bolt in the opposite direction.

BRIEF DESCRIPTION OF THE DRAWINGS

To better understand the object of the present application, figures in which several practical embodiments are depicted schematically and only by way of non-limiting example are attached.

DESCRIPTION OF PREFERRED EMBODIMENTS

In view of the mentioned figures a preferred embodiment of the invention is described.

Figure 1:
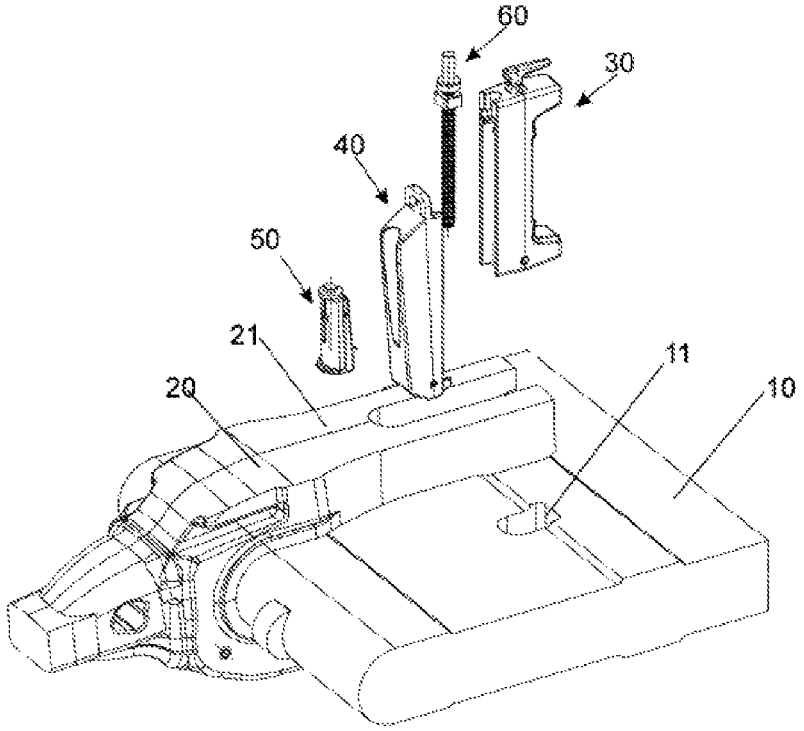
FIG. 1—Explosive view of the assembly and locking system objects of the present invention with an adapter and a blade where the locking system is introduced.
Figure 2:
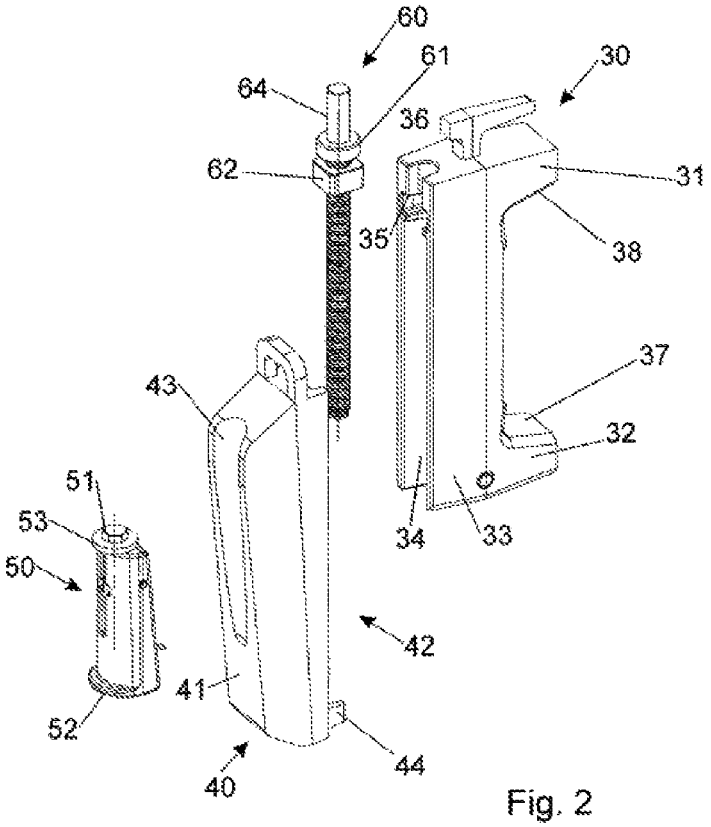
FIG. 2—Explosive view of the locking system.
Figure 3:
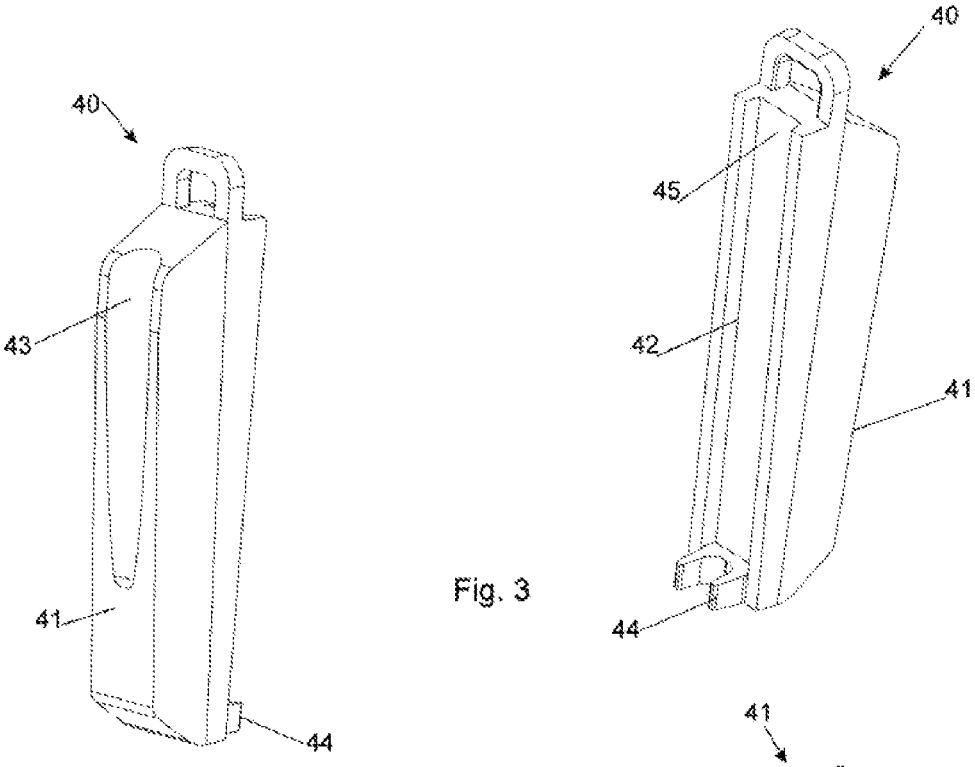
FIG. 3—A front and rear view of the wedge structure.
Figure 4:
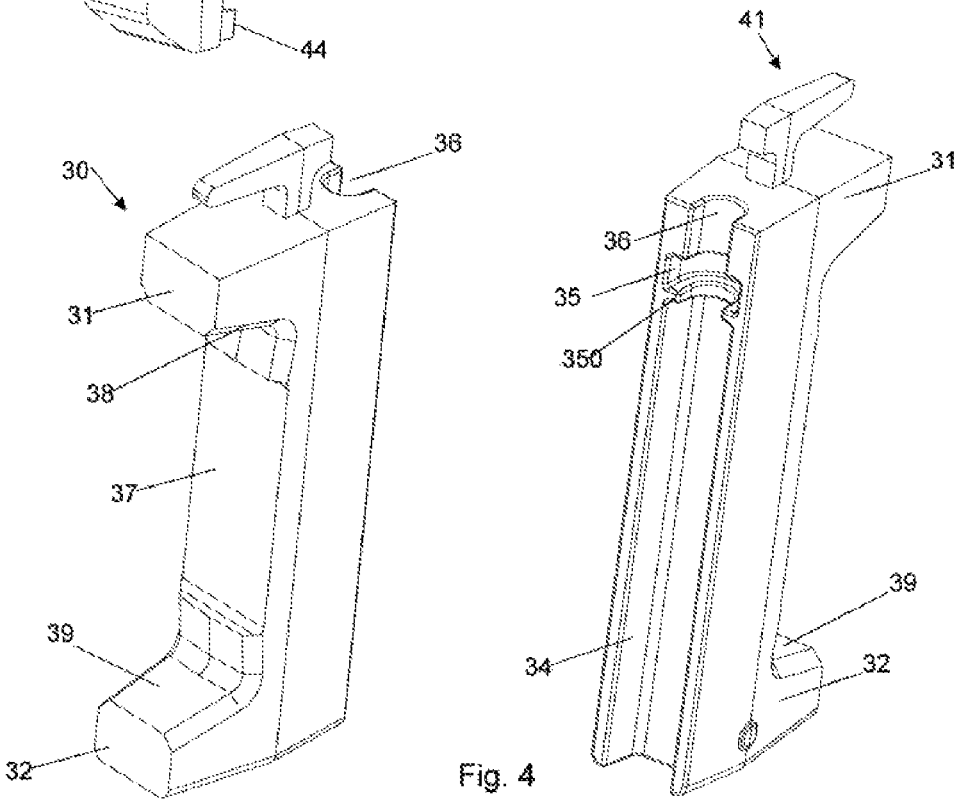
FIG. 4—A front and rear view of the C-clamp member.
Figure 5:
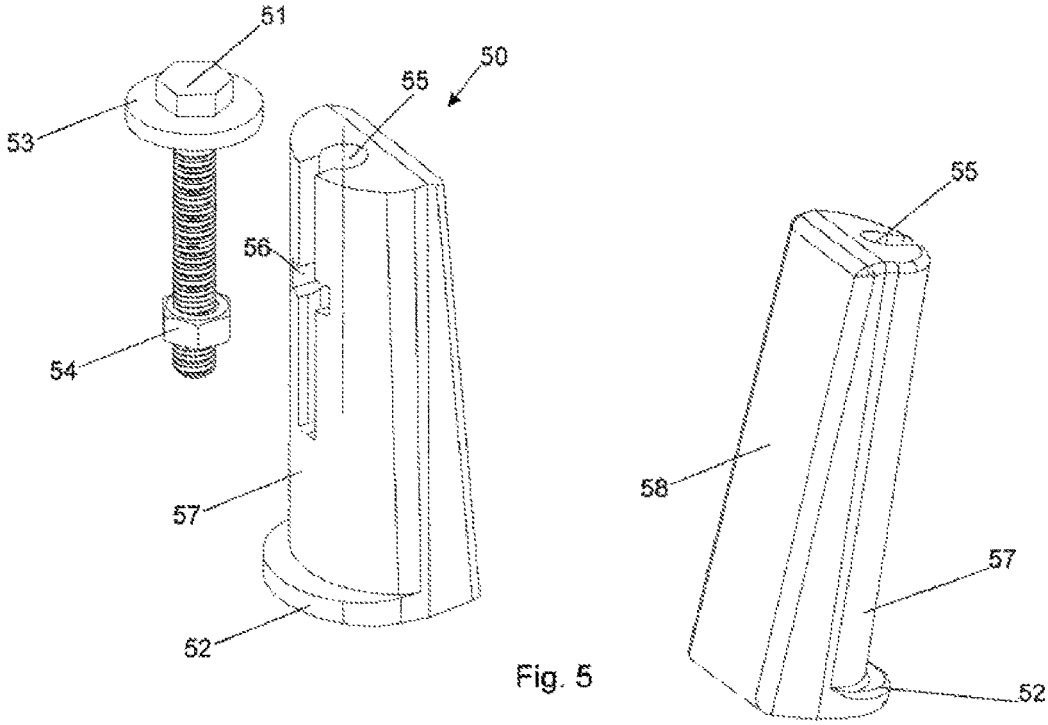
FIG. 5—A front and rear view of the front structure.

FIG. 1 shows an embodiment of an assembly and a locking device according to the invention, and FIG. 2 shows the components of the locking system. In this figure all the components of the invention can be seen. The adapter 20 is coupled on the blade 10 of the bucket having said adapter 20 a hole or opening 25 in its upper arm 21 and lower arm 22 and the blade 10 a though hole 11. Said holes 11, 25 are aligned when the adapter 20 is coupled on the blade 10. The locking system is then introduced in the channel formed by the previous holes or openings 25, 11 of the adapter 20 and blade 10 respectively.

The locking system comprises a front structure 50 with a lower projection 52 and comprising a removable upper projection 53 that is attached to the body of the front structure 50 by a bolt 51, and said bolt 51 is introduced in a vertical cylindrical housing 55 of the body of the front structure 50. The back face 58 of the front structure 50 is slightly inclined and preferably flat, with respect to the front face 57 determining a wedged-shape structure with an upper base of the body of the front structure (50) smaller that the lower base. This upper base smaller than the lower base determine the wedge shape of the front structure 50 along its length. The upper projection or washer 53 can be part of the bolt 51, can be fixed to the head of the same, or can be independent of the bolt 51. Further, said bolt 51 can be screwed to a nut 54 that is placed in a housing 56 that interferes with the cylindrical housing 55. An alternative to said construction could be that the cylindrical housing 55 has a thread for screwing the bolt 51 in it. The front face 57 has preferably the same shape as the surface 12 of the front portion of the hole 11 in the blade. Said shape is preferably curved. The back face 58 of said front structure is in contact, when the locking system is mounted in the assembly, with the front face 41 of a wedge structure 40.

Said wedge structure 40 comprises a back face 42 with a slot 45 along its length. The slot 45 has a rectangular cross shape. The front face 41, in contact when mounted on the assembly with the back face 58 of the front structure 50, is slightly inclined with respect to the back face 42, determining a wedge-shaped structure 40. Said front face is complementary to the back face 58 of the front structure 50 and therefore preferably flat too. At the lower end of the slot it comprises a stopping projection 44. Said stopping projection or stopping means 44 can also be placed anywhere along the length of the slot, and preferably in the mid-lower half of the slot. It further comprises in its front face 41 a hollow space 43 that extends along part of said front face 41. The back face 42 of this wedge structure 40 is in contact, when mounted, with the front face of the C-clamp member 30.

Said C-clamp member 30 comprises a front face and a back face. The back face comprises an upper 31 and lower 32 legs to be mounted on the outer surfaces of the respective arms 21, 22 of an adaptor 20 that at the same time are placed on the upper surface 14 and lower surface 15 of a blade 10. The surfaces 38, 39 of the upper 31 and lower 32 legs are inclined and with plain shape. The surface 37 between both legs 31, 32 is partly flat to contact the surface 13 of the back portion of the hole of the blade 11. The front face of the C-clamp member 30 will be in contact with the back face 41 of the wedge structure 40. Said front face comprises a slot 34 that extends nearly all along the whole length of the C-clamp 30 with a rectangular cross shape. This slot 34 is interrupted at the upper end by a housing 35 with preferably different cross shape, preferably circular cross shape, placed within said slot 34. This housing 35 interrupts the slot 34 by a protuberance 350 with small width. Above the housing 35, another upper slot section 36, usually shorter that the slot (34), with a smaller diameter than that of the housing 35, is placed.

Inside the slot 34 of the C-clamp member 30 a bolt 60, preferably with the same length as the front face of the C-clamp member 30 is inserted. Said bolt 60 has a square or rectangular nut 62 threaded to it. The upper end of the bolt 60 has a circular washer 61 that is part of the bolt 60, and farther in the same end, it comprises means 64 for screwing the bolt 60 with the help of a tool. These means 64 are also part of the bolt 60. The square or rectangular nut 62 is placed within the rectangular shaped slot 34 of the C-clamp member 30, the circular washer 61 is blocked inside the housing 35 and the means 64 for being held by a tool are placed inside the upper slot section 36.

After describing the components of the locking system, the sequence for introducing said components in an assembly of an adapter on a blade of a bucket will be described attending to FIGS. 6 to 13.

Figure 6:
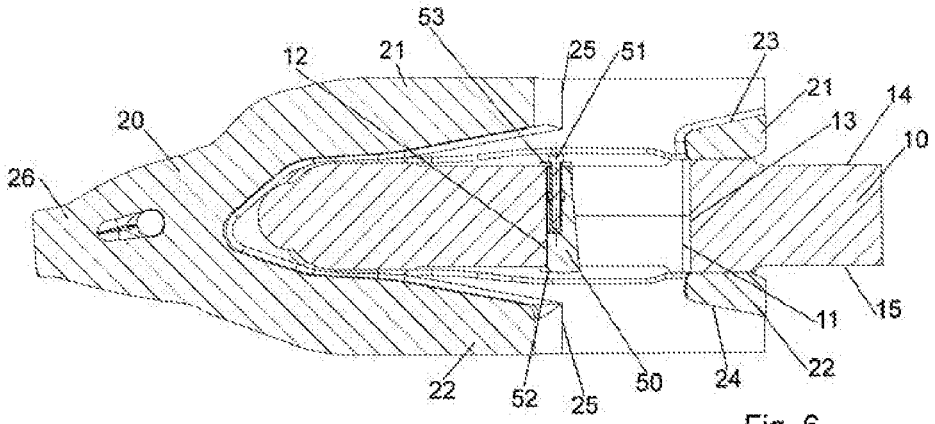
FIG. 6—A sectional view of an adapter coupled to a blade, and the front structure placed in the channel.

In FIG. 6 an adapter 20 with a nose 26 for coupling therein a tooth (not shown) is coupled on a blade 10 of a bucket. The adapter 20 comprises two arms, and upper arm 21 and a lower arm 22 that are placed on the upper surface 14 of the blade and on the lower surface 15 of the blade 10 respectively. The arms 21, 22 and the blade 10 have through holes 25, 11, respectively that are aligned when coupled determining only one channel. Said channel has a front portion with a front surface 12 and a rear portion with a rear surface 13, said surfaces being placed approximately perpendicular and between the upper 14 and lower 15 surfaces of the blade.

The upper arm 21 and lower arm 22 have inclined upward surfaces 23, 24 that go away from the channel 25.

After the coupling between the adapter 20 and the blade 10 has been made, the locking device must be introduced to secure the coupling between both parts. In first place the front structure 50 is inserted in the front portion of the channel and hole 11, with the front face 57 in contact with the front surface 12 of the hole 11, and the upper projection 53 in contact with the upper surface 14 of the blade 10 at said front portion of the hole 11. The removable upper projection or washer 53 is then tightened to the upper surface 14 of the blade 10 at the front portion of the hole 11 and as a consequence the lower projection 52 of the front structure 50 is tightened too to the lower surface 15 of the blade 10 at the front portion of said hole 11. To tighten the upper projection or washer 53 and the lower projection 52, the bolt 51 in the front structure 50 should be turned and screwed on to the nut 54, which is immobilized in the housing 56 of the front structure 50. The bolt 51 is screwed until the front structure 50 is fixed to the blade 10. To screw the bolt 51 in the nut 54 a tool is used, preferably a compact air wrench. The back face 58 of the front structure 50 is inclined and flat, so that the upper base of the structure is smaller than the lower one, having a wedged-shaped front structure 50.

Figure 7:
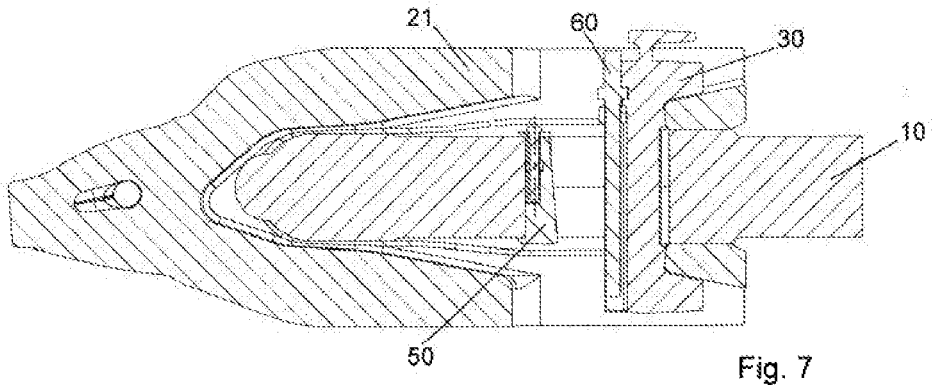
FIG. 7—A sectional view of an adapter coupled to a blade, and the front structure and the C-clamp member placed in the channel.
Figure 8:
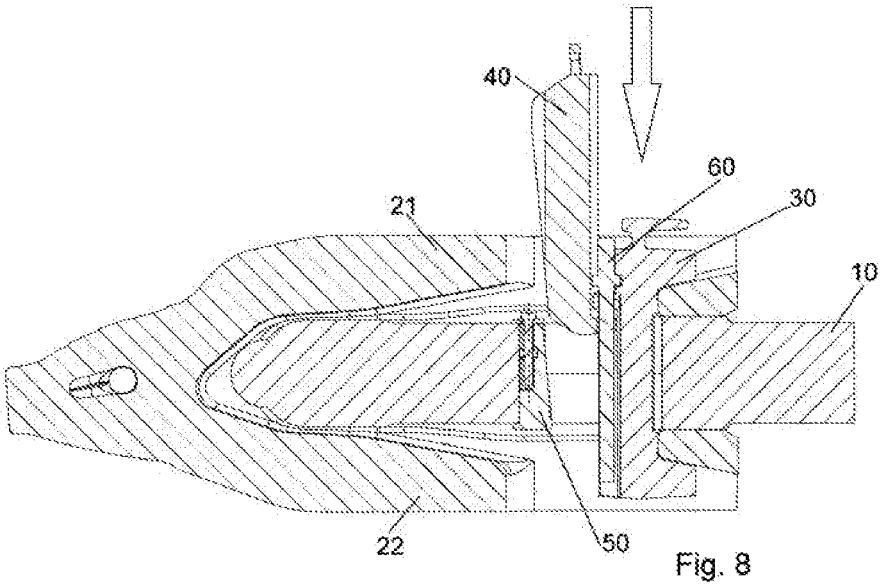
FIG. 8—A sectional view of an adapter coupled to a blade, with the wedge structure starting to be introduced between the front structure and the C-clamp member.

Afterwards, as shown in FIG. 7, the C-clamp member is introduced in the rear portion of the channel. The upper 31 and lower 32 legs of the C-clamp member 30 with inclined surfaces 38 and 39 respectively, are placed clamping the inclined surfaces 23, 24 of the upper 21 and lower 22 arms of the adapter 20. The rear surface 37 of the C-clamp member gets in contact with the rear surface of the rear portion of the hole 11 of the blade 10. The bolt 60 with the square or rectangular nut 62, is introduced in the slot 34 of the C-clamp member preferably before this part is introduced in the channel.

Now that the front structure 50 and the C-clamp member 30 are placed within the channel, there is a space between both to introduce the wedge structure 40. In a first approach, shown in FIG. 8, the wedge structure front face 41, inclined and flat, is placed over the flat and complementary inclined surface 58 of the front structure 50. On the opposite face of the wedge structure 40, the square or rectangular nut 62 of the bolt 60 placed in the slot 34 of the C-clamp member 30 is introduced in the slot 45 of the wedge structure 40. Once placed, the wedge structure 40 is pushed down manually until the same does not move between the front structure 50 and the C-clamp member 30.

Figure 9:
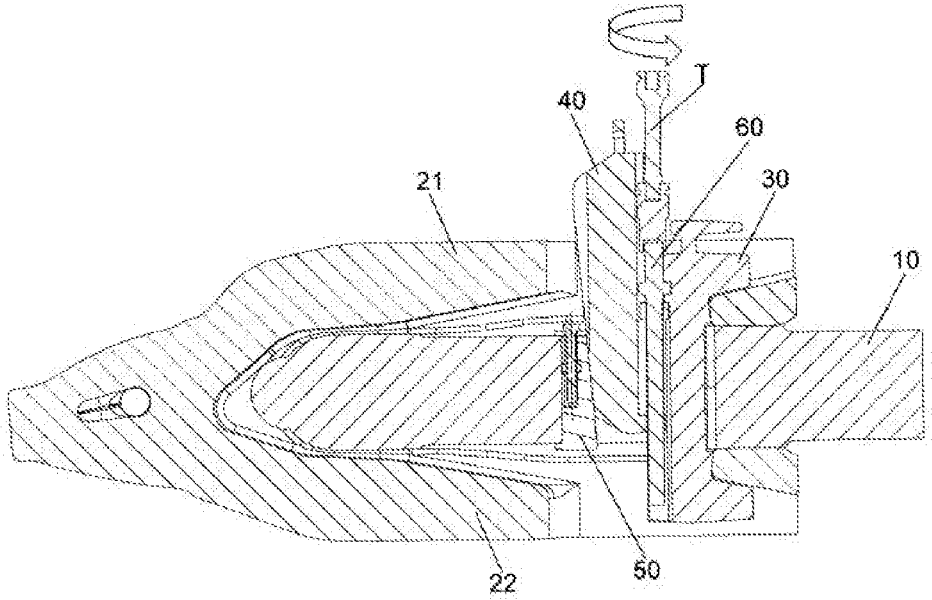
FIG. 9—A sectional view of an adapter coupled to a blade, with the wedge structure being pushed downwards when the bolt of the C-clamp member is turned with the help of a tool.
Figure 10:
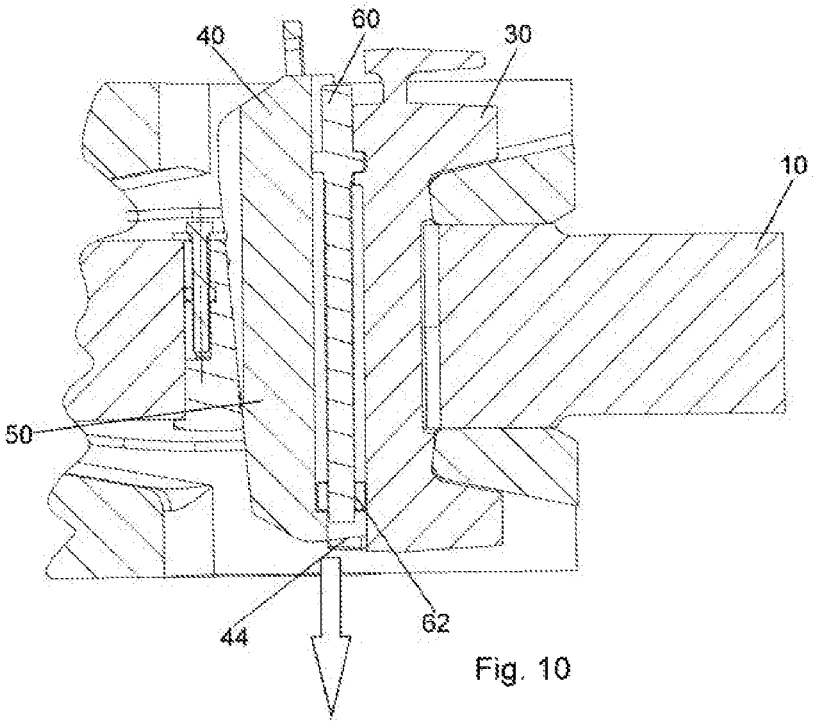
FIG. 10—A sectional view of an adapter coupled to a blade, with the wedge structure down in its working place.

To secure the position of the wedge structure 40 between both components 50, 30, and therefore secure the coupling of the adapter 20 to the blade 10 in an stable way, it is necessary to turn the means 64 for being held by a tool T on the upper end of the bolt 60, as shown in FIG. 9, said tool being, preferably, a compact air wrench. When said bolt 60 turns and as the same cannot move axially because it is blocked by the washer 60 inserted on the housing 35 of the C-clamp member 30, the rotation movement forces the square nut 62 that is trapped in the housing formed by the slot 45 of the wedge structure 40 and the slot 34 of the C-clamp member 30 downwards. As the nut 62 cannot rotate, the rotation of the bolt 61 around its axis without being able to displace axially, forces the nut 62 move downwards along the thread of the bolt 61. This movement downwards takes place while the nut 62 can push the stopping projection 44 in the wedge structure 40. When the nut 62 contacts the stopping projection 44 it starts to push the wedge 40 downwards through the stopping projection 44 and the wedge tightens the C-clamp member backwards, tightening the locking device. The inclined surfaces 38, 39 of the legs 31, 32 of the C-clamp member 30 press tightly on the inclined surfaces 23, 24 of the arms 21, 22 of the adapter 20 and this pressure is transmitted to the upper 14 and lower 15 surfaces of the blade 10. Now the assembly is ready to work once the tooth (not shown) is coupled to the nose 26 of the adapter 20.

Figure 11:
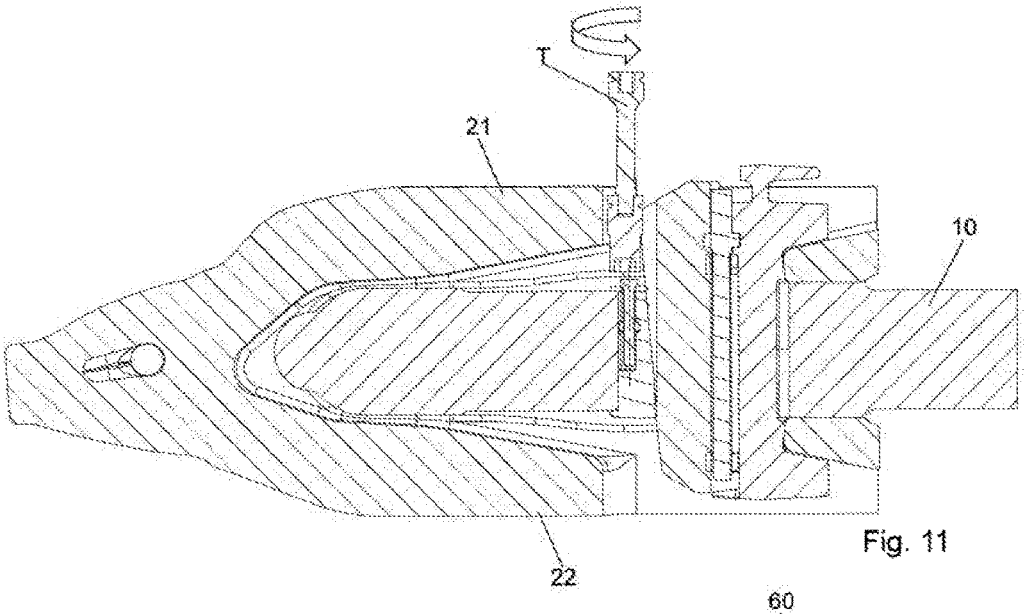
FIG. 11—A sectional view of an adapter coupled to a blade, with the wedge structure in its working place and when the bolt of the front structure is being turned to remove said front structure from the hole/channel and therefore starting the remove of the locking system.
Figure 12:
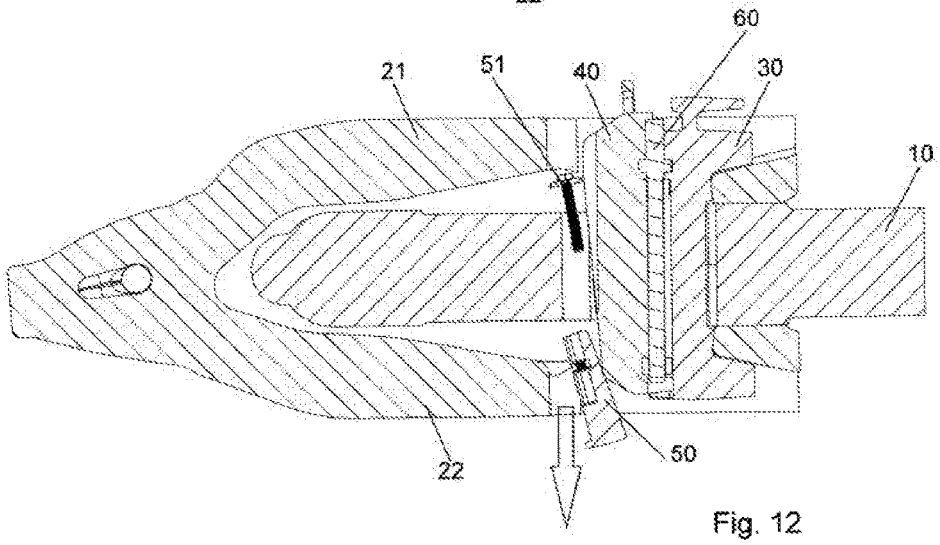
FIG. 12—A sectional view of an adapter coupled to a blade with the bolt of the front structure free from said front structure, and the front structure falling down the channel.

After some time working it will be necessary to replace the adapter 20 from the blade 10. When that moment arrives, in first place it is necessary to remove the locking system. The same is removed, as shown in FIG. 11, by unscrewing the bolt 51 of the front structure 50. To reach the head of the bolt 51 of the front structure 50, a tool T is introduced in the hollow space or slot 43 placed in the front face of the wedge 40. When said bolt 51 is unscrewed, the upper projection or washer 53 is separated from the front structure 50, and said front structure 50 will fall due to its weight or if necessary can be extracted by being pushed downwards.

Figure 13:
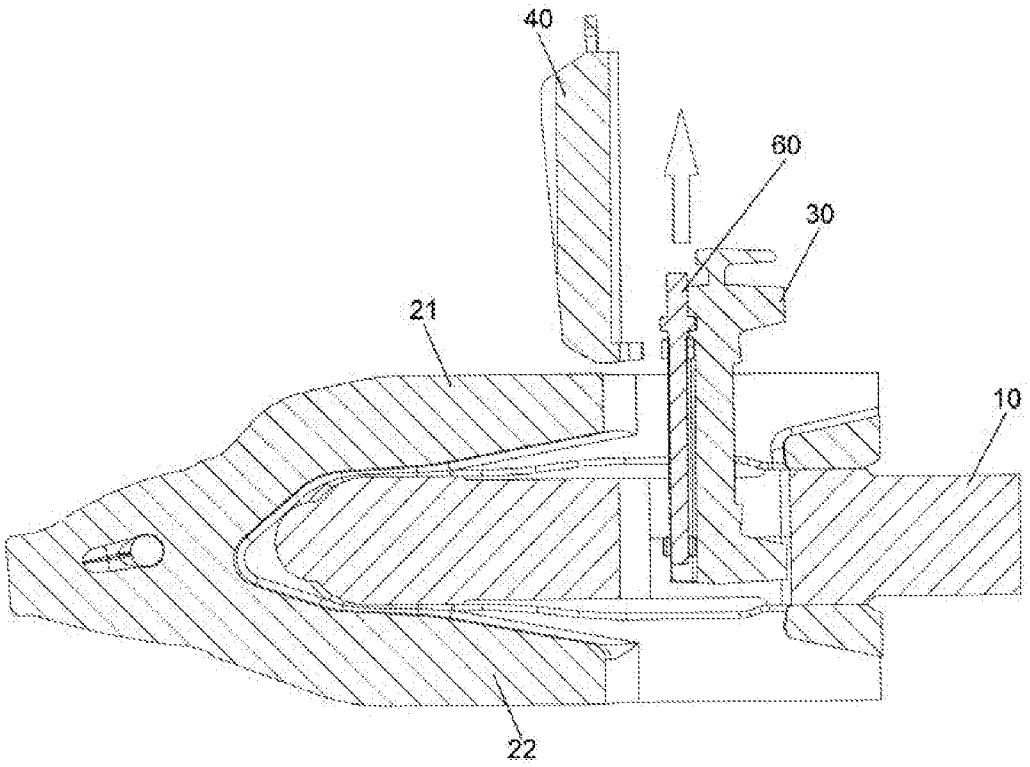
FIG. 13—A sectional view of an adapter coupled to a blade, with the front structure out of the assembly and the wedge structure being extracted.

As shown in FIG. 13, once the front structure 50 has been extracted, there is no obstacle for the wedge structure 40 to be extracted too. Afterwards the C-clamp member 30 can be extracted too, and the adapter 10 uncoupled from the blade 10.

In an alternative embodiment where there is no front structure as the one described, the front face 41 of the wedge 40 will be in contact with the front surface 12 of the hole or channel 11 after the C-clamp member 30 has been introduced in the channel. Therefore, after the C-clamp member 30 has been placed in the rearward of the hole 11, with its legs 31, 32 on the arms 21, 22 of the adapter 20, the wedge 40 is placed within the channel as described for the previous embodiment with the bolt 60 and nut 62. In this embodiment, when the locking device, formed by said wedge 40 and C-clamp member 30 wants to be removed, the bolt 60 should be rotated in the opposite direction as the one for securing the wedge 40 and the C-clamp member 30. With this rotation, with the help of a tool, the bolt 60 will exit from the slot 42, 34 and the wedge 40 can be extracted.

The invention claimed is:

1. A front structure for a locking device for attaching a wear part to a blade of an earth moving machine, said front structure is a one body structure comprising:

a front face configured such that, when said front structure is assembled to secure the wear part to the blade, the front face faces forward towards a free distal end of the wear part and abuts an opposing surface of a hole in the blade;

a back face inclined with respect to the front face so as to determine a wedge shape of the body structure having an upper base smaller than a lower base;

a lower projection, projecting forward beyond the front face; and an upper projection, removably attached to the body structure such that said upper projection can be separated from the structure, and when attached to the body structure said upper projection projecting forward beyond the front face so as to form, together with said front face and said lower projection, a C-shaped configuration.

2. The front structure, according to claim 1, wherein the upper projection is attached to the front structure by removable means.

3. The front structure, according to claim 2, wherein said removable means are is a bolt.

4. The front structure, according to claim 3, comprising a vertical cylindrical housing for receiving the bolt and a nut inside a nut housing that intersects with said vertical cylindrical housing, so that the bolt, when received in the vertical cylindrical housing and turned, screws to the nut.

5. The front structure, according to claim 3, comprising a vertical cylindrical housing with a threaded portion configured to receive the bolt in threaded engagement.

6. The front structure, according to claim 2, wherein the upper projection is not part of the removable means and is placed between said removable means and the front structure.

7. The front structure, according to claim 2, wherein the upper projection is part of the removable means.

8. A locking device for attaching a wear part to the blade of an earth moving machine, comprising a front structure according to claim 1 and a wedge structure with two faces having one of said faces inclined relative to the other of said two faces.

9. The front structure, according to claim 1, wherein the upper projection and the lower projection extend parallel to each other and in a same direction to clamp the front structure on the blade.

10. A locking device for attaching a wear part to a blade of an earth moving machine, comprising:

a wedge structure with a front face and a back face, one of said front face and said back face having an inclination relative to the other, a C-clamp member with a back face with two legs and a front face, and a bolt between the C-clamp member and the wedge structure, wherein:

said wedge structure comprises in the back face of said wedge structure a slot along a length of the back face of said wedge structure and stopping means;

said C-clamp member comprises in a front face of said C-clamp member a slot, which is interrupted by a housing to prevent axial displacement of the bolt, and a nut placed within said slot in which the nut cannot rotate, said nut screwed to the bolt allowing axial displacement of the nut along the slot when the bolt rotates without axial displacement, such that when the slot of the wedge structure faces the slot of the C-clamp member, the nut is received in both slots, and when the bolt rotates the nut pushes the stopping means of the wedge.

11. The locking device, according to claim 10, wherein said stopping means is placed at a lower end of the slot of the wedge structure.

12. The locking device, according to claim 10, wherein the nut and the slots have complementary shapes.

13. The locking device, according to claim 10, wherein the bolt comprises a washer that is placed within said housing to prevent the axial displacement of the bolt when the bolt is rotated.

14. The locking device, according to claim 10, comprising a front structure to be attached to the blade, the front structure having a lower projection and wherein the front structure is a one body structure comprising:

a back face inclined with respect to a front face, determining a wedge shape of the body structure with an upper base smaller than a lower base, and further comprising a removable upper projection attached to the structure such that said upper projection can be separated from the structure; and wherein the back face of the front structure is placed in contact with the front face of the wedge structure.

* * * * *